US010043351B2

(12) United States Patent
Black et al.

(10) Patent No.: US 10,043,351 B2
(45) Date of Patent: Aug. 7, 2018

(54) SELF-SERVICE TERMINAL

(75) Inventors: Jonathan S Black, Dundee (GB); Grant C. Paton, Dundee (GB)

(73) Assignee: NCR Corporation, Atlanta, GA (US)

( * ) Notice: Subject to any disclaimer, the term of this patent is extended or adjusted under 35 U.S.C. 154(b) by 343 days.

(21) Appl. No.: 12/861,290

(22) Filed: Aug. 23, 2010

(65) Prior Publication Data

US 2012/0044154 A1 Feb. 23, 2012

(51) Int. Cl.
*G07F 19/00* (2006.01)

(52) U.S. Cl.
CPC ..... *G07F 19/205* (2013.01); *G07F 19/20* (2013.01)

(58) Field of Classification Search
None
See application file for complete search history.

(56) References Cited

U.S. PATENT DOCUMENTS 6,543,684 B1 * 4/2003 White et al. ..... 235/379
6,630,941 B1 * 10/2003 Addison ..... 715/702
7,850,073 B1 * 12/2010 Ramachandran ..... G06Q 20/18 235/379
2002/0079364 A1 * 6/2002 Davies ..... 235/381
2002/0129256 A1 * 9/2002 Parmelee et al. ..... 713/180
2003/0016211 A1 * 1/2003 Woolley ..... 345/173
2003/0177366 A1 * 9/2003 de Jong ..... G06F 21/34 713/184
2004/0034440 A1 * 2/2004 Middlebrook ..... 700/91
2005/0177522 A1 * 8/2005 Williams ..... G06F 21/31 705/72
2007/0084911 A1 * 4/2007 Crowell ..... 235/379
2007/0262134 A1 * 11/2007 Humphrey ..... G06Q 20/105 235/379
2008/0207203 A1 * 8/2008 Arthur ..... G06Q 20/322 455/435.1
2010/0227686 A1 * 9/2010 Brunet De Courssou et al. ..... 463/31
2011/0002096 A1 * 1/2011 Thorson ..... G06F 1/1618 361/679.04
2011/0060641 A1 * 3/2011 Grossman et al. ..... 705/14.36
2011/0145073 A1 * 6/2011 Richman et al. ..... 705/14.66

FOREIGN PATENT DOCUMENTS

JP 7129696 * 5/1995

* cited by examiner

*Primary Examiner* — Christopher Kohlman
(74) *Attorney, Agent, or Firm* — Schwegman, Lundberg & Woessner

(57) ABSTRACT

A self-service terminal is described. The terminal includes first and second touch sensitive units. Each of these touch sensitive units includes a display and a touch sensitive panel overlying the display. The second customer display is configured differently to the first customer display. The terminal also includes a processor operable to present (i) a screen comprising a plurality of different selectable options to a customer on the first customer display, and (ii) a screen associated with a selected selectable option on the second customer display, so that the customer can use the second touch sensitive unit to enter transaction details in a more private manner than by using the first touch sensitive unit.

10 Claims, 8 Drawing Sheets

SELF-SERVICE TERMINAL

FIELD OF INVENTION

The present invention relates to improvements in, or relating to, a self-service terminal.

BACKGROUND OF INVENTION

Self-service terminals are used to allow customers to execute transactions and/or access information at a public location in an unassisted, or minimally assisted, manner. One common type of self-service terminal is an automated teller machine (ATM).

To provide customers with an enhanced transaction experience, there has been a trend to provide larger displays on ATMs, and also to provide touch sensitive panels to allow a customer to execute a transaction by touching the panel at an area in registration with a desired option presented on the display. However, the use of touch sensitive panels and large displays can compromise customer privacy and security of customer entered information (such as the customer's personal identification number (PIN)).

It is among the objects of an embodiment of the present invention to provide the advantages of an enhanced customer experience while retaining customer privacy and security.

SUMMARY OF INVENTION

Accordingly, the invention generally provides methods, systems, apparatus, and software for a self-service terminal comprising two different touch sensitive panels, one of the touch sensitive panels being configured for enhanced privacy.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a self-service terminal comprising:

- a first touch sensitive unit comprising a first customer display and a first touch sensitive panel overlying the first customer display;
- a second touch sensitive unit comprising a second customer display and a second touch sensitive panel overlying the second customer display, the second customer display being configured differently to the first customer display; and
- a processor operable to present (i) a screen comprising a plurality of different selectable options to a customer on the first customer display, and (ii) a screen associated with a selected selectable option on the second customer display, so that the customer can use the second touch sensitive unit to enter transaction details in a more private manner than by using the first touch sensitive unit.

The first (or second) customer display and the first (or second) touch sensitive panel overlying the first (or second) customer display may be implemented by a touch-sensitive panel in registration with a display surface of a display; alternatively, the display may comprise a projector, and the touch sensitive panel may comprise an opaque surface on which images are projected by the projector. Where a projection system is used, the touch sensitive panel may be coupled to an imager for sensing touches on the opaque surface.

The second customer display may be configured differently to the first customer display in that the first customer display may comprise a larger display area than the second customer display.

The second customer display may be configured differently to the first customer display in that the first customer display may be oriented differently to the second customer display. For example, the first customer display may be oriented in a generally upright position; whereas, the second customer display may be oriented in a generally level position. The upright position may be between approximately minus forty-five degrees to vertical and approximately zero degrees to vertical. In some embodiments, the upright position may be between approximately minus thirty degrees to vertical and approximately zero degrees to vertical. The level position may be between approximately minus thirty degrees to horizontal and plus thirty degrees to horizontal. In some embodiments, the level position may be between approximately minus ten degrees to horizontal and plus ten degrees to horizontal.

The second touch sensitive unit may be located in a position on the terminal fascia that would otherwise be occupied by an encrypting PINpad. In other words, the second touch sensitive unit may be provided on the terminal instead of an encrypting PINpad, thereby avoiding the need for the terminal to have a physical encrypting PINpad.

The second customer display may present advertising if the second customer display is not required when a selectable option is selected.

If the customer touches the second touch sensitive unit when an advertisement is being displayed, then the processor may replace a current screen on the first customer display with a screen providing further information about the advertisement.

The terminal may further comprise a short-range radio transceiver (such as an NFC transceiver) located adjacent to the second touch sensitive unit so that a customer can place a cellular telephone on (or near) the transceiver to convey details from the cellular telephone to the terminal. The details may include a telephone number of the cellular telephone. These details may be used as part of a transaction, such as a telephone account top-up transaction (that is, a transaction to purchase pre-paid telephone call time).

The self-service terminal may comprise an automated teller machine (ATM), an information kiosk, a financial services centre, a bill payment kiosk, a lottery kiosk, a postal services machine, a check-in and/or check-out terminal such as those used in the retail, hotel, car rental, gaming, healthcare, and airline industries, or the like.

The term "screen" is used herein to denote the graphics, text, controls (such as selectable options), and such like, that are presented on a display; thus, the term "screen" as used herein refers to software, it does not refer to the hardware (that is, the display) that presents the graphics, text, controls, and such like. Typically, when a transaction is being entered at a self-service terminal, a series of screens are presented in succession on the self-service terminal display, the next screen displayed being dependent on a user entry or activity relating to the current screen.

By virtue of this aspect there is provided a self-service terminal that has two touch sensitive units that co-operate with each other to allow a customer to enter information using the second touch sensitive unit as part of a transaction selected using the first touch sensitive unit. The second touch sensitive unit can also be used for increased privacy, so that private information is presented on the second customer display rather than on the first customer display.

According to a second aspect of the invention there is provided a method of operating a self-service terminal, the method comprising the steps of:

presenting a plurality of selectable options on a first customer display, each selectable option having an associated information screen;

detecting a customer selecting one of the selectable options; and presenting an information screen on a second customer display where the information screen is associated with the selected option.

The information screen may comprise an information entry screen to facilitate customer entry of information, and/or an information presentation screen to provide a customer with private information.

A selectable option may relate to a type of authentication required for a transaction. For example, one selectable option presented on the first customer display may produce a screen on the second customer display requesting entry of a personal identification number (PIN); another selectable option presented on the first customer display may produce a screen on the second customer display requesting selection of images in a defined sequence (a so-called picture PIN); another selectable option presented on the first customer display may produce a screen on the second customer display requesting the customer to write (using a stylus or his/her finger) a signature (or other stroke or sequence of strokes) on the second touch sensitive panel; another selectable option presented on the first customer display may produce a screen on the second customer display requesting the customer to enter a username and passcode combination.

A screen associated with PIN entry may comprise an image of a numeric PINpad including images of numerals "0" to "9", "Enter", "Clear", and "Cancel".

A screen associated with selecting images in a defined sequence may comprise an array of different images (such as photographs, line drawings, or the like).

A screen associated with writing a stroke sequence may comprise an image of a canvas on which the customer can delineate one or more strokes.

A screen associated with entering a username and passcode may include two fields, one for a username, the other for a passcode. The screen associated with entering a username and passcode, or another screen associated with that screen and presented simultaneously therewith, may present a keyboard.

The method may comprise the further step, subsequent to the step of detecting a customer selecting one of the selectable options, of presenting a guidance graphic (such as an arrow, which may be animated) to guide the customer to the second customer display, so that the customer is informed that he/she should use the second touch sensitive unit to enter information.

The second customer display may also be used for presenting private information to the customer, such as an account balance, information relating the customer's medical condition, or the like.

By virtue of this aspect, a second customer display can present information to a customer that is based on a screen presented on the first customer display.

According to a third aspect there is provided a computer program operable to implement the steps of the second aspect.

The computer program may be embodied on a carrier, such as a disk drive, computer memory, or a removable storage medium, or transmitted as a propagating signal.

According to a fourth aspect there is provided a self-service terminal comprising a first touch sensitive unit and a second touch sensitive unit, where both touch sensitive units may be used by the customer to enter information for a single transaction.

According to a fifth aspect there is provided a self-service terminal comprising a first customer display and a second customer display, where both displays may be used by the customer during a single transaction.

The terminal may further comprise an operator display for use by a service engineer. The operator display may only be visible when an opaque door of the terminal is opened.

For clarity and simplicity of description, not all combinations of elements provided in the aspects recited above have been set forth expressly. Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

DETAILED DESCRIPTION

Figure 1:
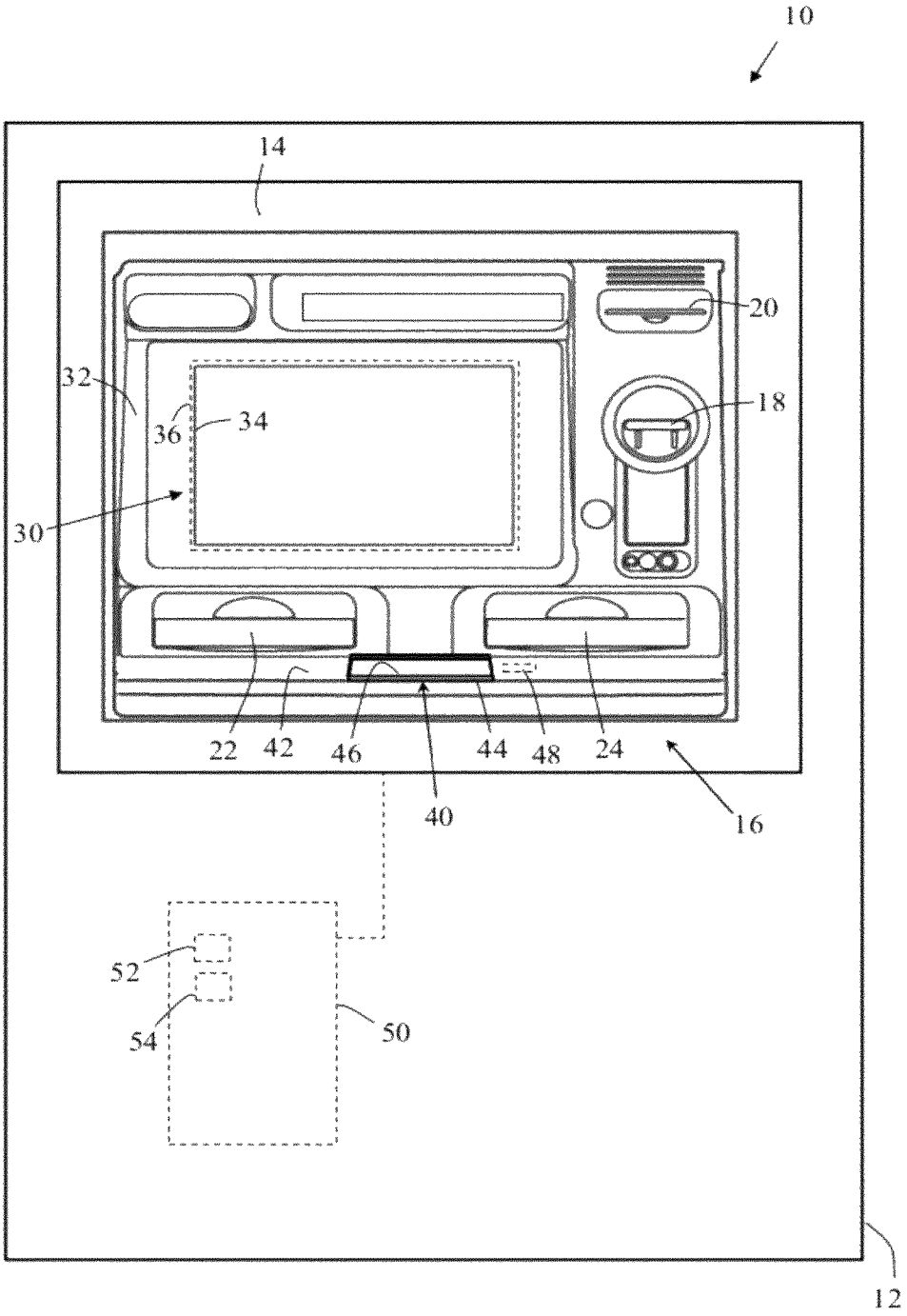
FIG. 1 is a pictorial front view of a self-service terminal (in the form of an ATM) including a first and second customer display, according to one embodiment of the present invention.

Reference is first made to FIG. 1, which is a pictorial front view of a self-service terminal 10, in the form of a lobby ATM, according to one embodiment of the invention.

The ATM 10 has a cabinet 12 to which is mounted a plastic fascia 14.

The fascia 14 provides part of a user interface 16 to allow a customer to interact with the ATM 10. In particular, the fascia 14 has apertures (or slots) aligning with internal devices (not shown).

The fascia 14 defines: a card reader slot 18; a receipt printer slot 20; a deposit slot 22 (closed by a shutter when not being used for depositing media items); and a dispenser slot 24 (closed by a shutter when not being used for dispensing banknotes).

A first touch sensitive unit 30 is mounted on an upright portion 32 of the fascia 14 and comprises: a first customer display 34 on which is mounted a first touch sensitive panel 36 in overlapping relationship therewith so that the first customer display 34 and the first touch sensitive panel 36 are in registration.

A second touch sensitive unit 40 is mounted on a flat shelf portion 42 and comprises a second customer display 44 on which is mounted a second touch sensitive panel 46 in overlapping relationship therewith so that the second customer display 44 and the second touch sensitive panel 46 are in registration.

In this embodiment, the first touch sensitive unit 30 is mounted at approximately minus ten degrees to the vertical (that is, the unit 30 is inclined backwards from vertical), and the second touch sensitive unit 40 is mounted at approximately plus five degrees to the horizontal. These angles are not critical, and many other different angles could be used (including vertical and horizontal), but a slight incline backwards from vertical for the first touch sensitive unit 30 and a slight incline forwards from horizontal for the second touch sensitive unit 40 generally provide an improved customer experience.

In this embodiment, the first customer display 34 comprises a fifteen inch (15") display, and the second customer display 44 comprises a seven point two inch (7.2") display.

Mounted underneath the shelf portion 42, and adjacent to the second touch sensitive unit 40, is an NFC transceiver 48 (illustrated in broken line in FIG. 1).

The modules in the ATM 10, including the first and second touch sensitive units 30,40, are controlled by a PC core controller module 50 (shown in broken line in FIG. 1). The PC core controller 50 includes many conventional hardware computer devices, such as a motherboard, a display adapter, serial ports, a disk drive, an Ethernet controller, and the like. These conventional computer devices are not shown in detail. However, a processor 52 and associated memory 54 are illustrated in FIG. 1, in broken line. Those of skill in the art will know that the processor 52 and memory 54 are coupled to the conventional computer devices listed above (and other conventional computer devices not listed specifically).

Figure 2:
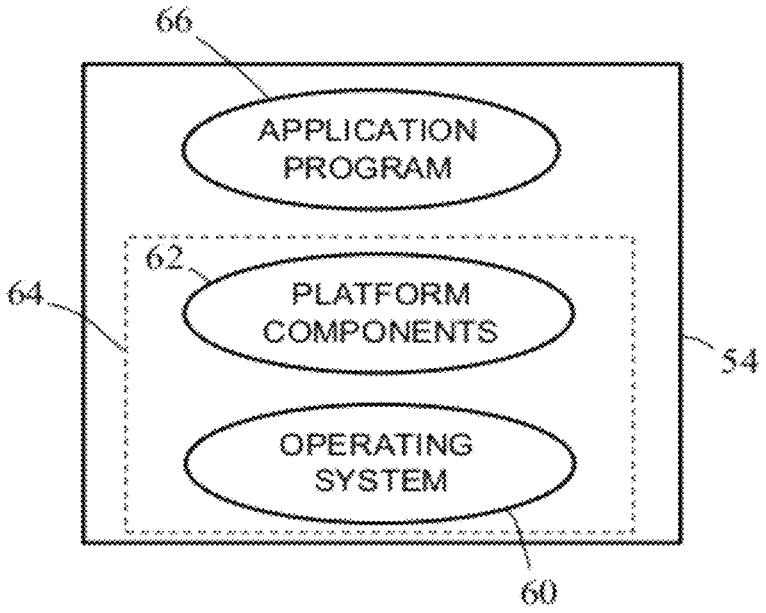
FIG. 2 is a block diagram illustrating software components executing in a part (the memory) of the terminal of FIG. 1.

Reference will now also be made to FIG. 2, which is a block diagram illustrating software components executing in the memory 54.

The memory 54 includes an operating system 60 loaded therein when the ATM 10 is booted up. In this embodiment the operating system is the Windows 7 (trade mark) operating system available from Microsoft Corporation (trade mark) of One Microsoft Way, Redmond, Wash. 98052-6399, USA. One advantage of using Windows 7 is that it handles touch inputs separately from mouse clicks, unlike previous versions of the Windows operating system.

The memory 54 also includes runtime platform components 62 in the form of APTRA (trade mark) XFS components (available from NCR Corporation, 3097 Satellite Blvd., Duluth, Ga. 30096, USA) comprising proprietary device drivers, an XFS manager, and XFS service providers. The platform components 62 provide a range of programming facilities specific to self-service terminal devices and services.

The combination of the operating system 60 and the runtime platform components 62 is referred to as the platform 64.

The memory 54 also includes an application program 66. The application program 66 is responsible, inter alia, for: (i) presenting screens on the first and second customer displays 34,44, (ii) collating selections made by the customer and data entered by the customer to create a transaction request, (iii) transmitting the transaction request to a remote authorization host (not shown), and (iv) controlling the self-service terminal to complete the authorized transaction (for example, by dispensing a requested amount of cash). The application program 66 is also operable to connect to other servers to access information relating to travel, accommodation, and the like.

The application program 66 interacts with the modules within the ATM (such as the cash dispenser, the receipt printer, the customer displays 34,44, and the like) via the platform 64.

Figure 3A:
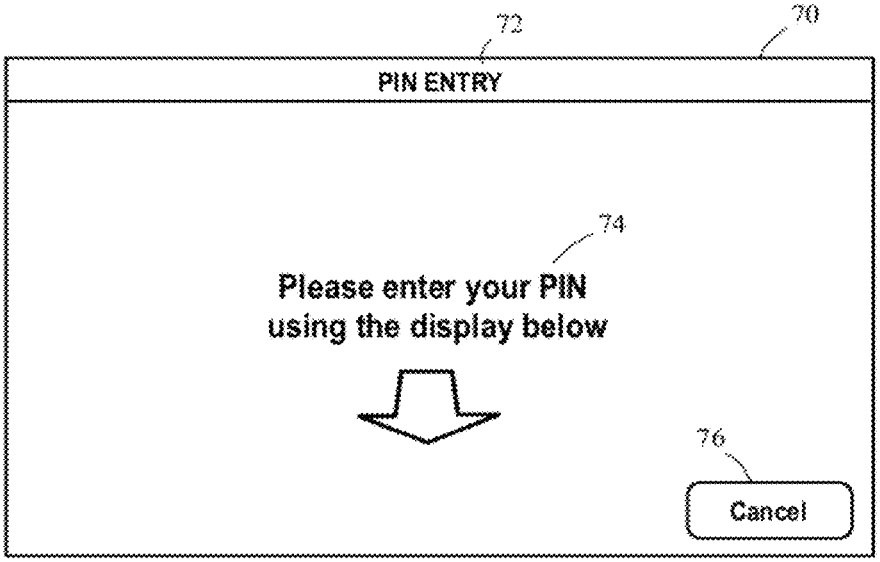
FIG. 3*a* is a pictorial diagram illustrating a screen (a PIN request screen) presented on the first customer display of the terminal of FIG. 1.
Figure 3B:
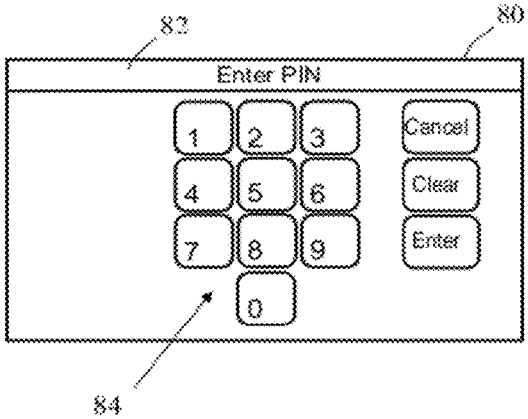
FIG. 3*b* is a pictorial diagram illustrating a screen (a PINpad screen) presented on the second customer display of the terminal of FIG. 1 simultaneously with the first customer display presenting the PIN request screen shown in FIG. 3*a;*

In this embodiment, the application program 66 coordinates the screens presented on the first customer display 34 and the second customer display 44, as will now be described in more detail with reference to FIGS. 3*a* and 3*b*, which are pictorial diagrams illustrating two different screens.

Initially, a customer inserts his/her identification card into the card reader slot 18. The ATM 10 reads this card and presents a PIN request screen 70 (FIG. 3*a*) on the first customer display 34, and a PINpad screen 80 (FIG. 3*b*) on the second customer display 44.

The PIN request screen 70 includes a banner field 72 indicating that the screen 70 relates to PIN entry; a guidance graphic (including text and an arrow) 74 indicating to the customer that he/she should use the second touch unit 40 to enter his/her PIN; and a selectable cancel option 76 to allow the customer to cancel the transaction and retrieve his/her card.

The PINpad screen 80 includes: a banner field 82 indicating that the screen 80 relates to entry of the customer's PIN; and a depiction of a conventional PINpad 84, having ten numerals, and a Clear, Cancel, and Enter option. The customer can enter his/her PIN by touching the second touch sensitive panel 46 at locations in registration with the desired numbers presented on the second customer display 44.

Figure 4C:
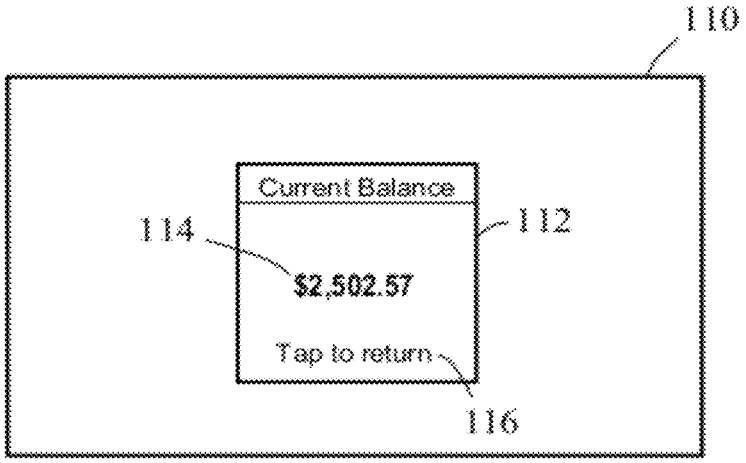
FIG. 4*c* is a pictorial diagram illustrating a screen (a balance display screen) presented on the second customer display of the terminal of FIG. 1 subsequent to the customer selection of one of the objects rendered on the financial category screen shown in FIG. 4*a*, and simultaneously with presentation of the balance selection screen of FIG. 4*b;*
Figure 4A:
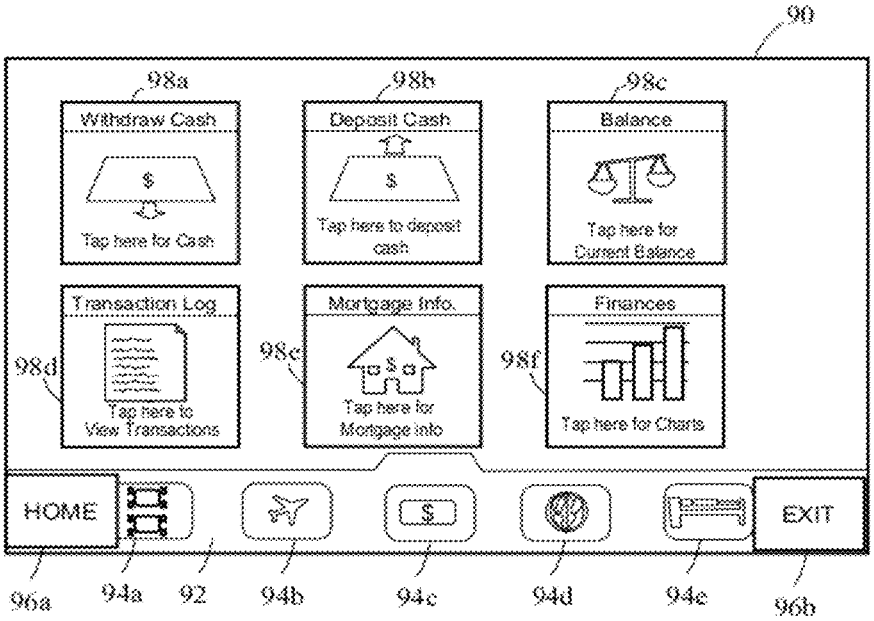
FIG. 4*a* is a pictorial diagram illustrating a screen (a financial category screen) presented on the first customer display of the terminal of FIG. 1.
Figure 4B:
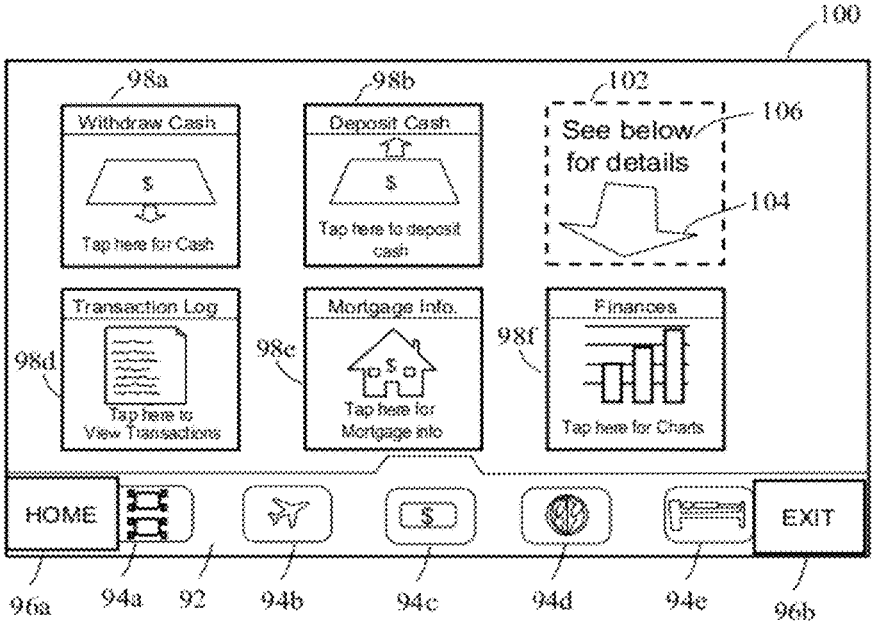
FIG. 4*b* is a pictorial diagram illustrating a screen (a balance selection screen) presented on the first customer display of the terminal of FIG. 1 subsequent to a customer selection of one of the objects rendered on the financial category screen.

Once the customer has entered his/her PIN, then the application program 66 proceeds to the next step. This will be described with reference to FIGS. 4*a* to 4*c*, which are pictorial diagrams illustrating three different screens. The next screen presented by the application program 66 is a financial category screen 90, which is presented on the first customer display 34.

The financial category screen 90 comprises a category strip 92 along which a plurality of category options 94 are presented. These category options 94 include: an entertainment category 94*a* (providing access to media downloads that can be purchased), a travel category 94*b* (providing access to travel information and transactions), a finance category 94*c* (selection of which results in the financial category screen 90 being rendered on the first customer display 34), a concierge category 94*d* (providing information about and directions to desired events, locations, and facilities), and an accommodation category 94*e* (providing access to information and transactions about hotels and other accommodation). These categories are merely examples of categories that may be included on the category strip 92.

The financial category screen 90 also comprises two general navigation options 96: a home option 96*a* that returns the screen to a home screen (not shown), and an exit option 96*b* (that cancels the current selection). These two navigation options 96 appear on every category screen.

In addition to these standard options, the financial category screen 90 includes some selectable options specific to that screen 90. These options all relate to finance, and include: a cash withdrawal transaction option 98*a*; a cash deposit transaction option 98*b*; a current balance option 98*c*; a transaction history option 98*d*; a mortgage information option 98*e*; and a financial summary option 98*f*.

In this example, a customer desires to see his/her current balance, so he/she selects the current balance option 98*c*. The application program 66 detects this selection (via the touch sensitive panel 36 and its associated drivers (not shown)) and presents balance selection screen 100 (FIG. 4*b*) on the first customer display 34 and balance display screen 110 (FIG. 4*c*) on the second customer display 44. The balance display screen 110 is presented at the same time as the balance selection screen 100.

The balance selection screen 100 is similar to the financial category screen 90, but the current balance option 98*c* has been removed and a guidance graphic 102 (which is animated) is provided in the location occupied by the current balance option 98*c*. The animated guidance graphic 102 includes a moving arrow 104 pointing the customer towards the second customer display 44, and text 106 informing the customer that details of the customer's balance are provided on the second customer display 44.

The balance display screen 110 renders a graphic 112 that includes the customer's current balance (in this example, $2,502.57) 114 and text 116 informing the customer that he/she can return to the previous menu by touching the second customer display 44 (although it is actually the second touch sensitive panel 46 that is touched by the customer).

By providing the current balance on the second customer display 44, it is more difficult for a third party to see the customer's balance by so-called "shoulder surfing". This is partly because the second customer display 44 is oriented in a nearly-horizontal plane (whereas, the first customer display 34 is oriented in a nearly-vertical plane), and partly because the second customer display 44 is smaller than the first customer display 34. If additional privacy is desired, then upstanding privacy wings may be provided on the shelf portion 42 of the fascia 14 at opposite sides of the second customer display 44.

Figure 5:
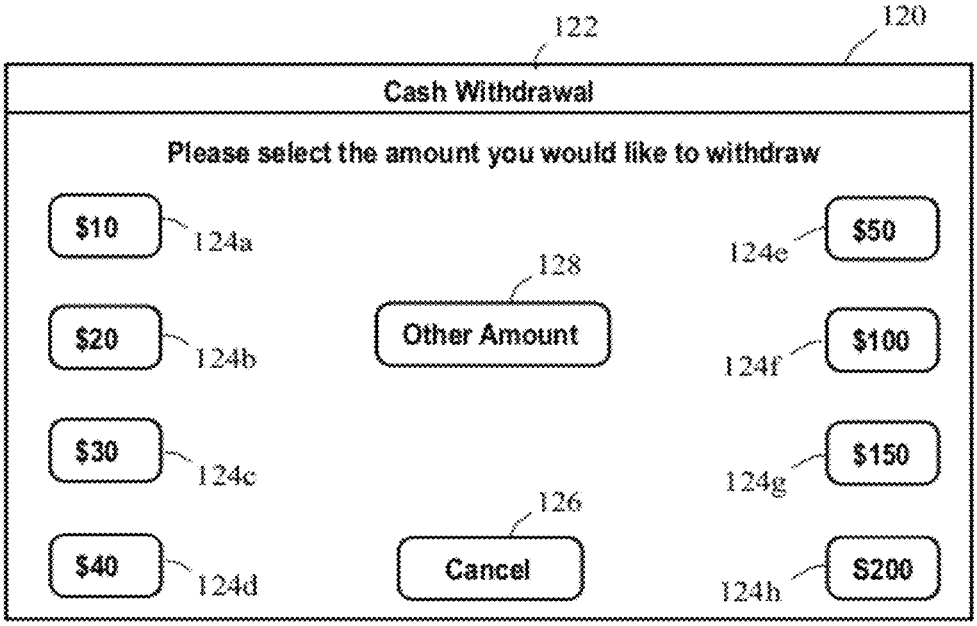
FIG. 5 is a pictorial diagram illustrating a screen (an amount screen) presented on the first customer display of the terminal of FIG. 1.

Referring again to FIG. 4*a*, if the customer selects the cash withdrawal transaction option 98*a*, then the application program 66 presents an amount screen 120 (FIG. 5) on the first customer display 34. The amount screen 120 comprises a banner field 122 indicating that the screen 120 is an amount entry screen; eight selectable transaction amount options 124*a* to *h*; a selectable cancel option 126 to allow the customer to cancel the transaction and return to the financial category screen 90; and a selectable other amount option 128 to allow the customer to type in an amount not presented as a selectable transaction amount.

Other options in different categories (or within the finance category 94*c* (such as mortgage information 98*e*)) may require or permit a customer to use a different verification mechanism, such as the customer's signature, or a defined stroke or sequence of strokes. This will be described by reference to FIGS. 6*a* and 6*b*, which are pictorial illustrations of signature entry screens on each of the first and second customer displays 34,44.

Figure 6A:
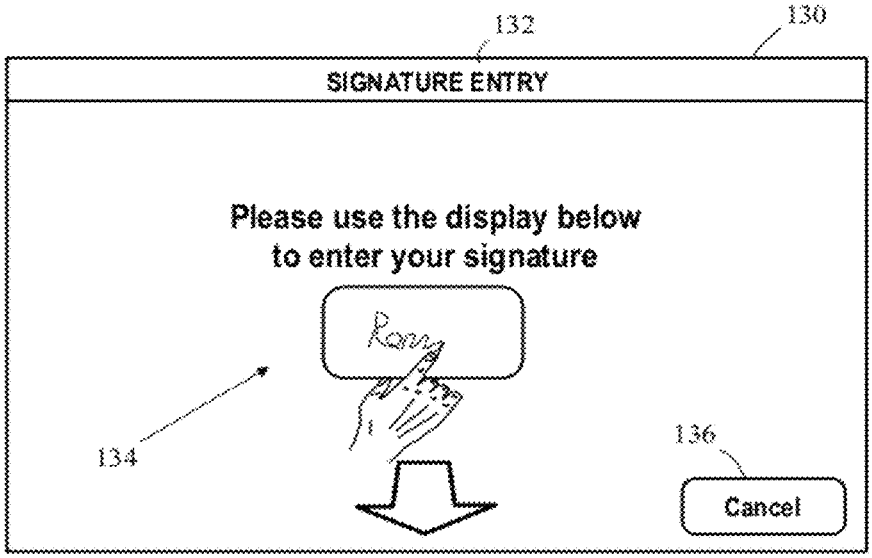
FIG. 6*a* is a pictorial diagram illustrating a screen (a signature request screen) presented on the first customer display of the terminal of FIG. 1.

As shown in FIG. 6*a*, a signature request screen 130 is presented on the first customer display 34 and comprises: a banner field 132 indicating that the screen 130 relates to signature entry; a guidance graphic (including text, an image, and an arrow) 134 indicating to the customer that he/she should use the second touch unit 40 to enter his/her signature; and a selectable cancel option 136 to allow the customer to cancel the transaction and return to the category screen he/she started at. In FIG. 6*a*, the image in the guidance graphic 134 illustrates a customer's hand writing directly onto the second touch sensitive unit 40.

Figure 6B:
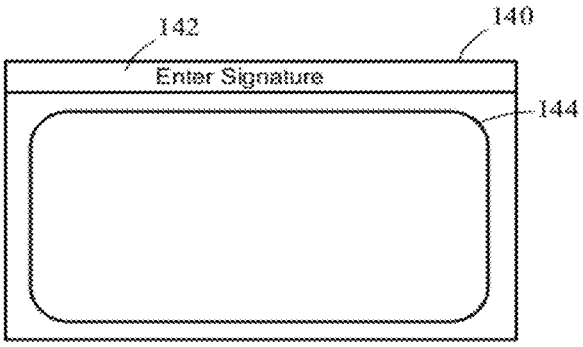
FIG. 6*b* is a pictorial diagram illustrating a screen (a signature entry screen) presented on the second customer display simultaneously with the first customer display presenting the signature request screen.

As shown in FIG. 6*b*, a signature entry screen 140 includes: a banner field 142 indicating that the screen 140 relates to entry of the customer's predefined signature (which may be a rendering of the customer's name, or part thereof, or merely one or more strokes); and a canvas area 142 to indicate to the customer that his/her stroke should be delineated in that area 142.

Once the customer has delineated his/her signature, then the program application 66 presents the next screen in the transaction sequence.

Yet another option within one of the categories in the category strip 92 may require or permit a customer to use yet another verification mechanism, such as a picture sequence. This will be described by reference to FIGS. 7*a* and 7*b*, which are pictorial illustrations of picture sequence entry screens on each of the first and second customer displays 34,44.

Figure 7A:
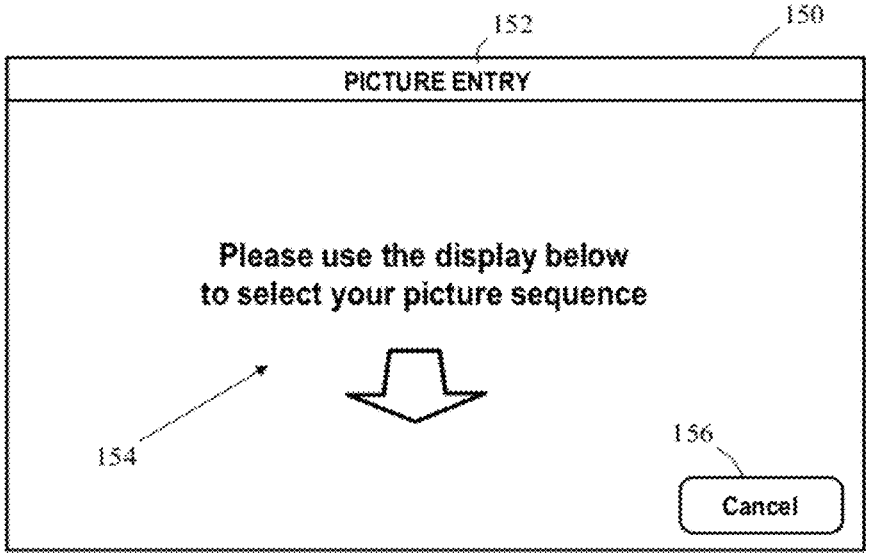
FIG. 7*a* is a pictorial diagram illustrating a screen (a picture sequence request screen) presented on the first customer display of the terminal of FIG. 1.

As shown in FIG. 7*a*, a picture sequence request screen 150 is presented on the first customer display 34 and comprises: a banner field 152 indicating that the screen 150 relates to picture sequence entry; a guidance graphic (including text and an arrow) 154 indicating to the customer that he/she should use the second touch unit 40 to select his/her picture sequence; and a selectable cancel option 156 to allow the customer to cancel the transaction and return to the category screen he/she started at.

Figure 7B:
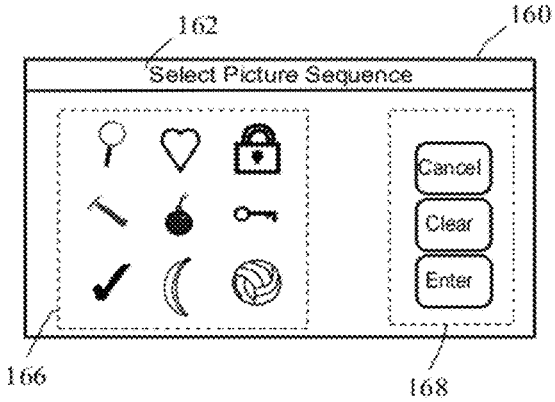
FIG. 7*b* is a pictorial diagram illustrating a screen (a picture sequence entry screen) presented on the second customer display simultaneously with the first customer display presenting the picture sequence request screen.

As shown in FIG. 7*b*, a picture sequence entry screen 160 includes: a banner field 162 inviting the customer to select a sequence of pictures; a three-by-three array of individually selectable pictures (illustrated by broken line 164); and individually selectable Clear, Cancel, and Enter options (illustrated by broken line 166).

Once the customer has selected his/her sequence of pictures from the array 164, then the program application 66 presents the next screen in the transaction sequence. Authentication of the entered picture sequence involves the program application 66 (or an authorization server (not shown)) comparing the entered sequence of pictures with a preselected sequence of pictures chosen by the customer during an enrolment phase. This is similar to how an entered numeric PIN is compared with a preselected numeric PIN to authenticate a customer.

Those of skill in the art will now appreciate that in the above examples the application program 66 co-ordinates the screen on the second customer display 44 to complement the screen on the first customer display 34 so that the customer interacts with both screens (one on each display 34,44) as part of a transaction. This can be used to provide increased security and/or privacy.

In addition to providing one screen that is used to input data relating to a transaction presented on another screen (simultaneously displayed), the two customer displays 34,44 can be used to provide different transactions, particularly where they both relate to similar transactions, as will now be described with reference to FIGS. 8*a* and 8*b*.

The first customer display 34 may be used for part of a transaction that requires relatively high resolution, such as capturing an image of a two dimensional barcode from the screen, as will be described with reference to FIG. 8*a*.

Figure 8A:
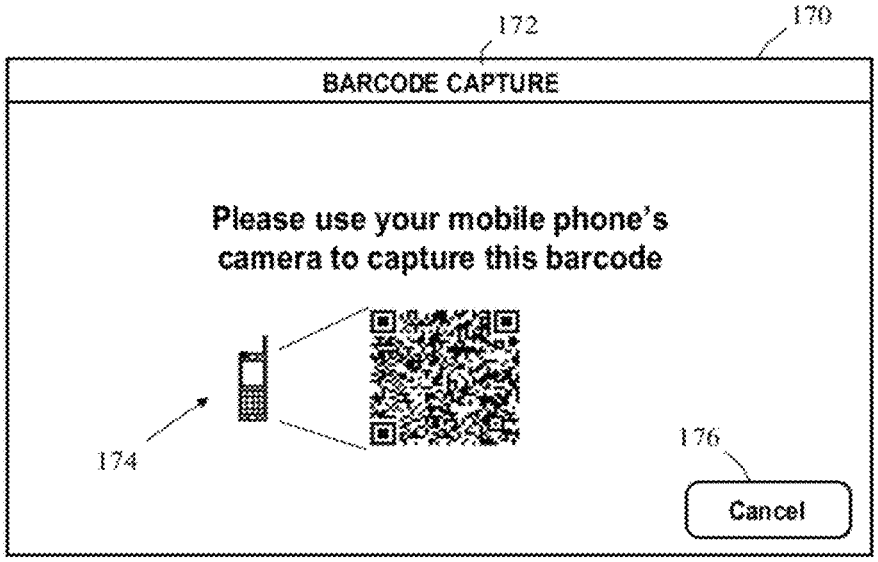
FIG. 8*a* is a pictorial diagram illustrating a screen (a barcode capture screen) presented on the first customer display of the terminal of FIG. 1.

As shown in FIG. 8*a*, a barcode capture screen 170 is presented on the first customer display 34 and comprises: a banner field 172 indicating that the screen 170 relates to capturing an image of a barcode; a guidance graphic (including text and an image of a mobile telephone) 174; a barcode image 176; and a selectable cancel option 176 to allow the customer to cancel the transaction and return to the original selection screen. In this screen, the guidance graphic 174 indicates to the customer that he/she should use his/her mobile (cellular) telephone's camera to capture an image of the barcode 176. Once captured by the telephone, the telephone's software (not shown) may interpret and act on the barcode (for example, by accessing a web site encoded into the barcode image).

In addition to using the second touch sensitive unit 40 to enter private information, the second touch sensitive unit 40 can be used to guide a customer to a part of the user interface that is closer to the second touch sensitive unit 40 than the first touch sensitive unit 30, for example the NFC transceiver 48 (FIG. 1). This will be described with reference to FIG. 8*b*, which is a pictorial diagram illustrating a telephone number entry screen 180.

Figure 8B:
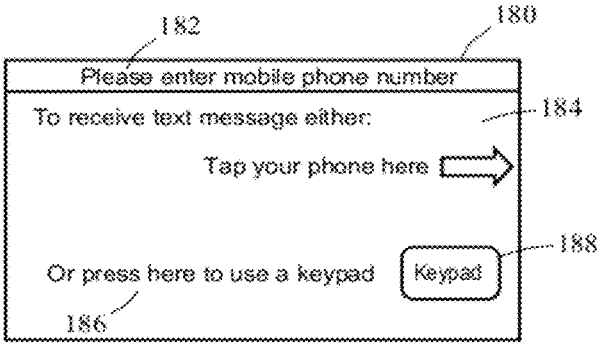
FIG. 8*b* is a pictorial diagram illustrating a screen (a telephone number entry screen) presented on the second customer display of the terminal of FIG. 1.

As shown in FIG. 8*b*, the telephone number entry screen 180 includes: (i) a banner field 182 inviting the customer to enter his/her mobile telephone number; (ii) text (and an arrow) 184 inviting the customer to tap his/her telephone on the NFC transceiver 48; and (iii) text 186 inviting the customer to select an option (labeled "Keypad") 188 to display a keypad via which the customer can enter his/her telephone number. This telephone number entry screen 180 may be provided to allow the customer to subscribe to alerts or other information provided by SMS messaging, electronic mail, or the like.

Various modifications may be made to the above described embodiment within the scope of the invention, for example, in other embodiments, different authentication mechanisms may be used than those described above.

In other embodiments, the second customer display may be used to present a screen including a full QWERTY keyboard.

In other embodiments, a through-the-wall ATM may be used instead of a lobby ATM. In other embodiments, a self-service terminal other than an ATM may be used.

In other embodiments, the configuration of the first and second customer displays (for example, the display sizes selected, the angle at which the displays are mounted, the location of the displays relative to each other, and the like) may differ from those described above.

In other embodiments, an identification card (and associated card reader) may not be required.

In other embodiments, the guidance graphic may take a different form than described above. For example, in other embodiments, a selectable option may move from a screen on the first customer display to a screen on the second customer display. Other animation methods could be used to guide the customer from one screen to another screen.

In other embodiments, the customer may be presented with a home screen first. The home screen may be presented prior to the customer authenticating himself/herself, or subsequent to the customer authenticating himself/herself. The home screen may provide the customer with a variety of different categories, such as those shown on the category strip 92.

In other embodiments, some options within a category, or some categories, may not require the customer to provide any identification. These options or categories may operate in a similar manner to an information kiosk.

The steps of the methods described herein may be carried out in any suitable order, or simultaneously where appropriate. The methods described herein may be performed by software in machine readable form on a tangible storage medium or as a propagating signal.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A self-service terminal comprising:

a first touch sensitive unit comprising a first customer display and a first touch sensitive panel overlying the first customer display, wherein the first touch sensitive unit is mounted on an upright portion of a fascia of the self-service terminal and the first touch sensitive panel in an overlapping relationship with the first customer display;

a second touch sensitive unit comprising a second customer display and a second touch sensitive panel overlying the second customer display, wherein the second touch sensitive unit is mounted on a flat shelf portion of the self-service terminal and the second touch sensitive panel in an overlapping relationship with the second customer display;

wherein the first customer display is larger than the second customer display;

and a processor operable to present (i) a first screen comprising a plurality of different selectable options to a customer on the first customer display, (ii) a second screen containing a request to the customer to enter private transaction details associated with a selected selectable option on the second customer display, (iii) coordinate information being presented within the first screen and the second screen, (iv) enable receipt of private transaction details through the second touch sensitive unit, (v) authenticate the customer from a customer-selected sequence of selected pictures presented on the second customer display through received selections provided on the second touch sensitive unit before the customer is permitted to enter the private transaction details on the second touch sensitive unit, and (vi) present any private information relevant to a transaction and associated with the transaction details with the second screen on the second customer display during the transaction.

2. A self-service terminal according to claim 1, wherein the second customer display is configured differently to the first customer display in that the first customer display is oriented differently to the second customer display.

3. A self-service terminal according to claim 1, wherein the second touch sensitive unit is located in a position on the terminal fascia that would otherwise be occupied by an encrypting PINpad on the flat shelf portion.

4. A self-service terminal according to claim 1, wherein the terminal further comprises a short-range radio transceiver located adjacent to the second touch sensitive unit.

5. A self-service terminal according to claim 1, wherein the self-service terminal comprises an automated teller machine.

6. The self-service terminal of claim 1, wherein the private second touch sensitive display is further configured to: render a private screen on the second display to present the private information to the customer during the transaction.

7. A method of operating a self-service terminal, the method comprising:

presenting a plurality of selectable options on a first customer display device oriented in a generally vertical position and mounted on an upright portion of a fascia of the self-service terminal, each selectable option having an associated information screen;

detecting a customer selecting one of the selectable options;

presenting an information entry screen containing a request to the customer to enter private transaction details on a private second customer display device that is mounted on a flat shelf portion of the self-service terminal, and wherein the second customer display device is separate and distinct from the first customer display device with the first customer display device being larger than the private second customer display device; and coordinating information being presented within the first customer display device and the private second customer display device with any private information being presented within the private second customer display device during a transaction on the self-service terminal, and wherein coordinating further includes authenticating, by the private second customer display device, the customer for entering the private transaction details on the private second customer display based on a sequence of selections made by the customer of pictures presented on the private second customer display.

8. A method of operating a self-service terminal according to claim 7, wherein each selectable option involves a different type of authentication required for the transaction.

9. A non-transitory carrier embodying a computer program operable to implement the steps of claim 7.

10. A self-service terminal comprising:

a first touch sensitive display mounted on an upright portion of a fascia of the self-service terminal and comprising a first display; and a private second touch sensitive display mounted on a flat shelf portion of the self-service terminal in a horizontal orientation and comprising a private display, wherein both touch sensitive displays configured to: (i) be operated by a customer to enter information for a transaction and view other information during the transaction, and (ii) coordinate between both touch sensitive displays to determine which of the touch sensitive displays is to present each portion of the other information during the transaction, and wherein the first touch sensitive display is configured to: (i) display a request to the customer to enter private transaction details for the transaction, (ii) present an animated guidance graphic arrow on the first display when the customer is to transition from the first display to the private display in order to view private information being presented during the transaction and when the customer is to enter private details during the transaction through the private send touch sensitive display of the private display; and wherein the private second touch sensitive display configured to: (i) present private information including the private transaction details privately within the private display during the transaction.

* * * * *